United States Patent [19]

Ochiai

[11] 4,063,524

[45] Dec. 20, 1977

[54] TWIN-NEEDLE SEWING MACHINE WITH GUIDE MEANS FOR SIMULTANEOUSLY STITCHING A PAIR OF CONCEALED SLIDE FASTENER STRINGERS TO A FABRIC

[75] Inventor: Koichi Ochiai, Monchen-Gladbach, Germany

[73] Assignee: Yoshida Kogyo Kabushiki Kaisha, Japan

[21] Appl. No.: 682,785

[22] Filed: May 3, 1976

[30] Foreign Application Priority Data

May 6, 1975 Japan ..... 50-61078[U]

[51] Int. Cl.[2] ..... D05B 35/10

[52] U.S. Cl. ..... 112/152; 112/163; 112/260

[58] Field of Search ..... 112/104, 113, 120, 150, 112/163, 235, 260, 152

[56] References Cited

U.S. PATENT DOCUMENTS

| | | | |
|---|---|---|---|
| 271,728 | 2/1883 | Miller | 112/260 |
| 1,230,354 | 6/1917 | Weis | 112/260 |
| 2,751,869 | 6/1956 | Walcoff | 112/260 |
| 3,011,459 | 12/1961 | McNamara | 112/260 X |
| 3,680,510 | 8/1972 | Ebata | 112/235 |

*Primary Examiner*—Werner H. Schroeder
*Assistant Examiner*—Moshe I. Cohen
*Attorney, Agent, or Firm*—Bucknam and Archer

[57] ABSTRACT

A throat plate holding the feed dog of a twin-needle sewing machine has formed therein a pair of parallel spaced guide channels for slidably accommodating respective scoop-carrying edges of the pair of concealed fastener stringer tapes as they are stitched onto a fabric. When seen in a cross section, the guide channels diverge downwardly to prevent accidental disengagement of the scoop-carrying edges of the stringer tapes therefrom.

3 Claims, 4 Drawing Figures

TWIN-NEEDLE SEWING MACHINE WITH GUIDE MEANS FOR SIMULTANEOUSLY STITCHING A PAIR OF CONCEALED SLIDE FASTENER STRINGERS TO A FABRIC

BACKGROUND OF THE INVENTION

1. Field of the Invention

This invention relates to sewing machines, and in particular to a twin-needle sewing machine for simultaneously stitching a pair of concealed slide fastener stringers onto a desired fabric. The invention is even more particularly directed to means for guiding the fastener stringers under the needles as they are stitched onto a fabric by such a sewing machine. The term "fabric" is used herein and in the appended claims in a broad sense, to mean any material to which fastener stringers can be sewn or stitched.

2. Description of the Prior Art

For simultaneously stitching a pair of concealed slide fastener stringers onto a fabric, it has been customary to use a twin-needle sewing machine the presser foot of which has a pair of guide channels formed in its bottom face for slidably receiving the respective rows of fastener elements of the stringers. This prior art device gives rise to various problems which adversely affect the efficiency with which the concealed fastener stringers are attached to successive pieces of fabric.

First of all, prior to stitching operation, the row of elements on one of the stringers must be manipulated into the corresponding one of the guide channels in the presser foot in its raised position. With this stringer supported under the presser foot with one hand, the operator proceeds to manipulate, with the other hand, the row of elements on the other stringer into the guide channel in the presser foot. The presser foot with the pair of stringers manually supported thereunder is then lowered onto the fabric which has been placed over the throat plate on the bed of the sewing machine.

Thus, according to the prior art device, the fastener stringers are deposited onto the fabric on the throat plate after having their rows of elements manipulated into the respective guide channels in the presser foot. It requires utmost skill on the part of the operator to speedily and properly install the fastener stringers between the presser foot and the fabric on the throat plate bacause the operator is deprived of his view of the stringers by the presser foot.

The fastener stringers placed in the above described manner between the presser foot and the fabric on the throat plate are usually in need of readjustment as to their longitudinal positions with respect to each other. For this readjustment the operator must first raise the presser foot, by operating its control lever with one of his hands, only to such an extent that the guide channels in the foot will not disengage the rows of elements, and he uses the other hand to readjust the longitudinal positions of the fastener stringers one with respect to the other.

The operator has heretofore been required to follow such a troublesome procedure preparatory to stitching of each pair of concealed fastener stringers to a fabric. Simplification of this preparatory procedure is certain to result in material enhancement of the efficiency with which pairs of concealed fastener stringers are machine sewn onto successive pieces of fabric.

SUMMARY OF THE INVENTION

It is therefore an object of this invention to provide improved guide means to be incorporated in a twin-needle sewing machine for guiding a pair of concealed slide fastener stringers in a predetermined direction as they are fed under the needles to be stitched onto a desired fabric.

Another object of the invention is to provide guide means of the character described which permits successive pairs of concealed slide fastener stringers to be readily installed in position on the sewing machine thereby minimizing its downtime.

A further object of the invention is to provide guide means of the character described whereby even an unskilled operator can easily install such stringers in position on the sewing machine, as he is permitted to handle each stringer with both hands and to see what his hands are doing.

In accordance with the invention, briefly stated, a throat plate on the bed of a twin-needle sewing machine is provided with a pair of guide channels for slidably accommodating respective rows of elements of a pair of concealed slide fastener stringers together with the longitudinal edges of the stringer tapes on which the elements are mounted. The guide channels are arranged at least partly parallel to each other and generally extend in a predetermined direction in which the fastener stringers together with a desired fabric are to be fed during stitching operation.

This inventive construction permits the operator to manipulate the element carrying edges of the stringer tapes into the respective guide channels with the stringers placed directly upon the throat plate, while the usual presser foot of the sewing machine is held in its raised position above the throat plate. The relative longitudinal positions of the pair of fastener stringers can also be readily adjusted with the element carrying edges of the stringer tapes held neatly received in the guide channels.

The installation of the fastener stringers in position on the throat plate is all the more easy because the operator is not deprived of his view of the stringers by the presser foot. For stitching these fastener stringers to a desired fabric, the fabric is placed over the stringers on the throat plate, and then the presser foot is lowered onto the superposed fabric and stringers.

According to a further feature of this invention, the pair of guide channels in the throat plate diverge downwardly when seen in a cross-sectional view. This is to prevent accidental disengagement of the element carrying edges of the stringer tapes from the guide channels, as when the relative longitudinal positions of the stringers are being readjusted.

The above and other objects, features, and advantages of this invention will become more clearly apparent in the course of the following description of a preferred embodiment, which is to be read in connection with the accompanying drawings.

DESCRIPTION OF THE PREFERRED EMBODIMENT

Figure 1:
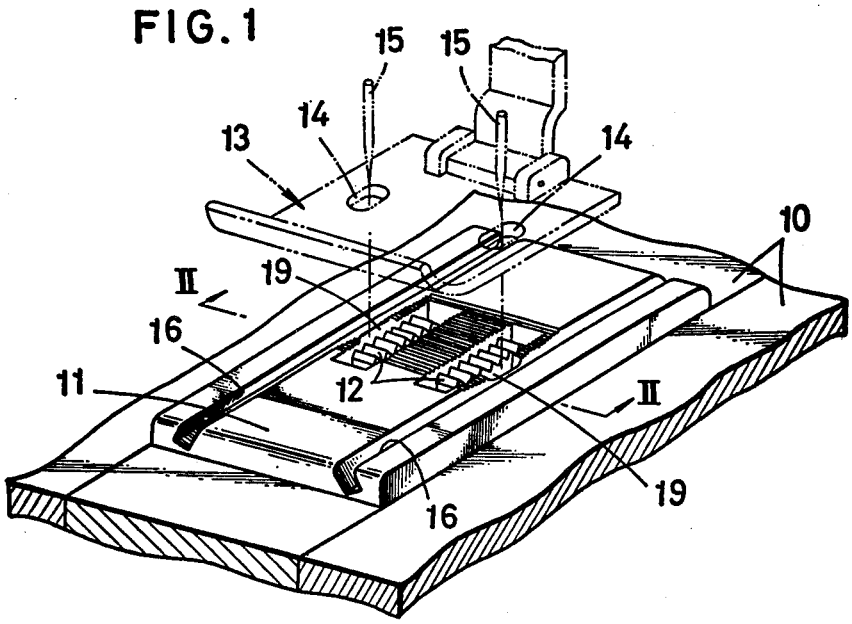
FIG. 1 is a perspective view of a preferred form of the stringer guide means of this invention as incorporated in a twin-needle sewing machine.

With particular reference to FIG. 1 of the accompanying drawings, there is fragmentarily shown at 10 the bed of a twin-needle sewing machine. A part of the bed 10 is constituted of a throat plate 11 holding a conventional feed dog 12 for feeding the material being stitched in a predetermined direction, which is upward as viewed in FIG. 3, over the bed 10. Supported over the throat plate 11 is a presser foot 13 having a pair of openings 14 to permit a pair of needles 15 to move up and down therepast for stitching operation.

Figure 2:
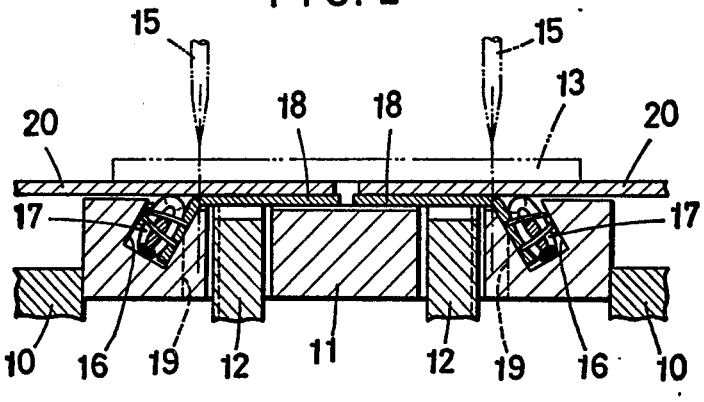
FIG. 2 is an enlarged cross-sectional view along the line II — II on FIG. 1, the view also showing a pair of concealed slide fastener stringers and pieces of fabric superposed thereon, which are placed in position on the sewing machine and ready for stitching operation.

As will be seen also from FIG. 2, the throat plate 11 has formed therein a pair of parallel spaced guide channels 16 for slidably accommodating respective rows of elements 17 together with the longitudinal edges of stringer tapes 18 on which the elements are mounted. The guide channels 16 extend in the said predetermined direction in which the material being stitched is fed by the feed dog 12 and, in the particular embodiment shown, diverge downwardly as seen in a cross-sectional view as in FIG. 2.

Also in the illustrated embodiment, the throat plate 11 is raised above the bed 10, to a height approximately equal to the depth, or maximum vertical dimension, of each guide channel 16, which can be constant throughout its length. This is to permit ready manipulation of the element carrying edges of the stringer tapes 18 into the respective guide channels 16 at their entrance ends, which are directed downwardly as seen in FIG. 3.

The throat plate 11 has a pair of transversely spaced openings 19 for permitting the passage therethrough of the respective needles 15 when they move up and down during stitching operation.

Figure 3:
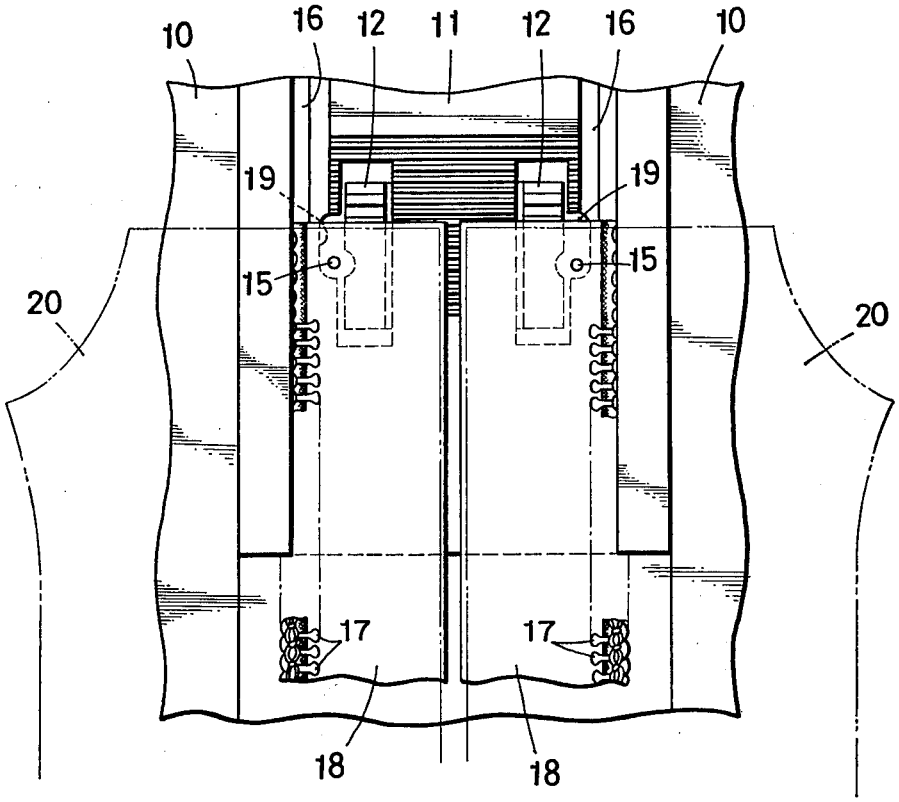
FIG. 3 is an enlarged top plan view of the arrangement of FIG. 2.
Figure 4:
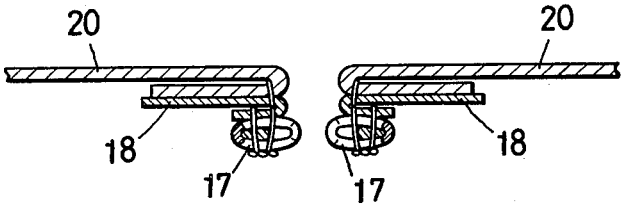
FIG. 4 is a transverse cross-sectional view of the concealed slide fastener stringers which have been stitched onto the pieces of fabric by the sewing machine of FIGS. 1 through 3.

FIGS. 2 and 3 are explanatory of the way the pair of stringer tapes 18 are stitched onto respective pieces of desired fabric 20 by the twin-needle sewing machine so as to provide a concealed slide fastener shown in FIG. 4. The fastener stringers are first placed on the throat plate 11 in parallel relationship, with the rows of elements 17 on the tapes 18 directed upwardly and disposed away from each other, while the presser foot 13 is in a raised position of FIG. 1. These rows of elements are then manipulated into the respective guide channels 16 in the throat plate 11 together with the outer edges of the tapes 18, and if necessary the longitudinal positions of the two stringers are manually readjusted one with respect to the other so that their ends may be in line. There is practically no possibility of the elements being disengaged accidentally from the guide channels 16 during such readjustment, because the guide channels diverge downwardly as aforesaid.

The fabric 20 is then placed in position over the fastener stringers. While FIGS. 2 and 3 show two pieces of the fabric, it is possible to stitch the stringers onto a single piece of such fabric and then to sever same between the stringers. Alternatively, the sewing machine may be equipped with an usual cutter so that the fabric may be severed simultaneously as the stringers are stitched thereto.

With the presser foot 13 subsequently lowered onto the superposed fabric and stringers as shown in FIG. 2, the sewing machine is set in motion. As the needles move up and down to simultaneously stitch the pair of stringer tapes 18 onto the fabric 20 along lines close to the rows of elements 17, the fabric and stringers will be fed straight ahead by the feed dog 12 with the rows of elements sliding along the respective guide channels 16.

Thus, the throat plate 11 has a generally flat surface between the guide channels 16 and this flat surface is disposed generally parallel to the bottom flat surface of the presser foot 13 so as to confine the other edge portions of each stringer tape 18 flat against the fabric 20 onto which these stringer tapes 18 are stitched. The guide channels 16, as seen in the cross-sectional plane of FIG. 2, are inclined divergently with and downwardly with respect to such flat surface of the throat plate.

Upon completion of stitching operation, the pieces of fabric 20 and the stringer tapes 18 are folded as shown in FIG. 4 and reversed as to left and right to bring the rows of elements 17 into opposed relationship to each other. The fastener stringers can be thoroughly concealed behind the fabric 20 when the row of elements 17 are interengaged by the usual slider, not shown, to close the fastener. The other details for completion of the concealed slide fastener on the fabric 20 obviously belong to the common knowledge of those skilled in the art and will therefore be omitted.

While the invention has been shown and described hereinbefore in terms of a specific embodiment thereof, it is not desired to limit the invention to the exact details disclosed. For example, the throat plate may be arranged flush with the sewing machine bed, and in this case the pair of guide channels formed in the throat plate may be each gradually increased in depth from the opposite extremities thereof toward the midpoint. It is also possible to make the guide channels divergent, when seen in a plan view as in FIG. 3, at their terminal portions. It is essential, however, that at least the midportions of the guide channels, located on opposite sides of the feed dog 12, be arranged parallel to each other.

The above and various other modifications or changes of this invention which will readily occur to those versed in the art are intended in the foregoing disclosure. The invention, therefore, should be construed broadly and in a manner consistent with the scope of the following claims.

What is claimed is:

1. In a sewing machine for simultaneously stitching onto a fabric a pair of concealed slide fastener stringer tapes each carrying a row of elements along one of the longitudinal edges thereof, wherein the sewing machine is of the type having a pair of needles movable up and down with respect to a bed past a presser foot supported thereover for stitching material being fed in a predetermined direction, the improvement comprising a throat plate arranged under said presser foot so as to constitute a part of said bed, said throat plate having formed therein a pair of guide channels generally extending in said predetermined direction each for slidably accommodating said one longitudinal edge of one of the stringer tapes together with the row of elements carried thereon, said guide channels being generally parallel to each other, said throat plate having a pair of openings for the passage therethrough of the respective needles, said throat plate having a generally flat surface between said guide channels and disposed generally parallel to a flat surface of the presser foot to confine the other edge portion of each stringer tape flat against said fabric onto which the stringer tape is stitched.

2. The improvement as recited in claim 1, wherein said guide channels are inclined divergently with respect to said flat surface of the throat plate.

3. The improvement as recited in claim 1, wherein said guide channels have a constant depth throughout their length, and wherein said throat plate is raised above said bed to a height approximately equal to the depth of said guide channels.

* * * * *